United States Patent [19]

Swallert

[11] Patent Number: 4,517,713

[45] Date of Patent: May 21, 1985

[54] COFFIN

[76] Inventor: Sven A. Swallert, 11, rue Michel-Chauvet, 1208 Geneva, Switzerland

[21] Appl. No.: 601,332

[22] Filed: Apr. 17, 1984

[51] Int. Cl.[3] ..... A61G 17/00

[52] U.S. Cl. ..... 27/4; 27/14

[58] Field of Search ..... 27/2, 4, 5, 6, 7, 19; 217/47

[56] References Cited

U.S. PATENT DOCUMENTS

| | | | |
|---|---|---|---|
| 183,974 | 10/1876 | Robinson | 27/19 |
| 727,277 | 5/1903 | Brady | 27/6 |
| 930,543 | 8/1909 | Hahn | 27/4 |
| 1,240,097 | 9/1917 | Stires | 217/47 |
| 2,317,605 | 4/1943 | Harris | 27/4 |
| 3,334,392 | 8/1967 | White | 27/19 |
| 4,399,596 | 8/1983 | Parlour et al. | 27/4 |

*Primary Examiner*—Robert A. Hafer
*Assistant Examiner*—Daniel Nolan
*Attorney, Agent, or Firm*—Young & Thompson

[57] ABSTRACT

A coffin comprising a box having a cover, an upper frame, a lower frame, and an inside fitting. The box has hinged lateral walls permitting its folding to a storage and transportation position in which its height is a fraction of its extended height. Alternate lateral walls are formed of only one flap hinged on one of the frames, the remaining lateral walls being comprised by two flaps hinged together along a middle line and to each of the frames respectively along directions parallel to that middle line. The cover is invertible on the upper frame, to a compact storage position.

5 Claims, 5 Drawing Figures

COFFIN

The wooden coffins which are used for the burials or cremations are relatively costly not only due to the material used for their manufacture but specially due to the impossibility to rationalize their manufacture, their storage and/or transportation raising space problems which cannot be solved.

The present invention has for its object a coffin, particularly a wooden coffin, the manufacture of which can be rationalized and the storage and the transportation of which require little space. This coffin comprises a box, a cover and an inside fitting and distinguishes itself by the fact that the box comprises hinged lateral walls enabling its folding into a storage and transportation position in which its height is a fraction of its height in service position.

The attached drawings show schematically and by way of example two embodiments of the coffin according to the invention.

Figure 1:
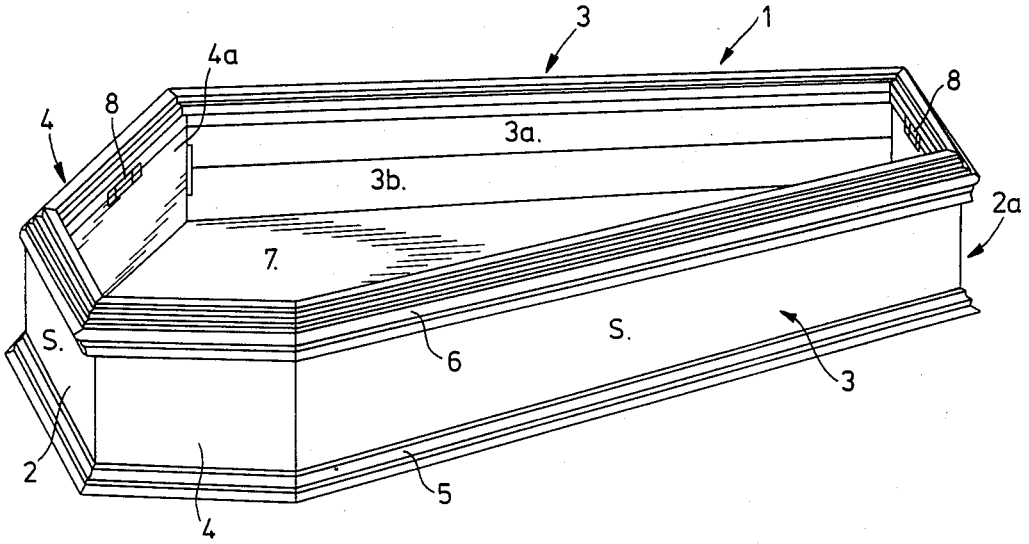
FIG. 1 shows in perspective the box of a first embodiment of the coffin.
Figure 2:
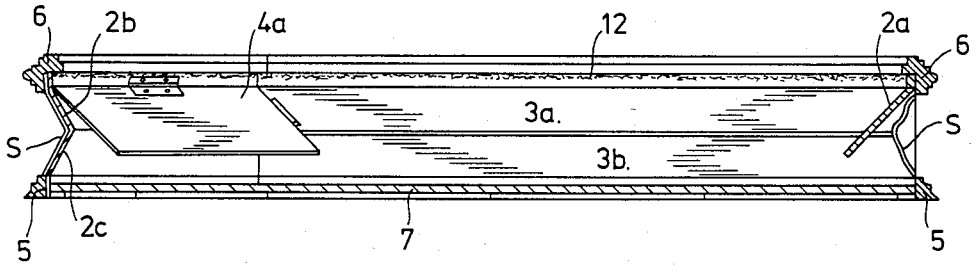
FIG. 2 is a longitudinal crosssection of the box shown in FIG. 1 during its folding.

The coffin shown in FIGS. 1 and 2 comprises a cover (not shown) intended to close the upper open face of a box 1 having six sides, two end faces 2,2*a*, two lateral faces 3 and two short faces 4.

All the walls 2,3 and 4 connect, in service position a lower rigid frame 5 to an upper, also rigid, frame 6.

The end face 2, as well as the lateral faces 3, are each formed of two panels 2*b*,2*c*; 3*a*,3*b* which are hinged the one with respect to the other and respectively on one of the frames 5,6. The outside surface of these walls is covered with a supple coating S which is resistant and tight.

The short walls 4 and the end faces 2*a* are made of only one flap occupying in service position the whole height between the frames 5 and 6. This flap is hinged on only one of said frames. The coating S covering the walls 2,3 covers also the flaps forming the small walls 4, and the wall 2*a*, but is not fixed to these flaps.

A rigid bottom 7 is fixed on the lower frame 5.

To fold the coffin in its storage and transportation position, one lifts the flaps 4 and 2*a* around their hinges 8 on the upper frame thus unlocking the box, then one puts together the upper 6 and lower 5 frames by folding the panels 2*b* and 2*c* of the wall 2, and 3*a*,3*b* of the walls 3 towards the inside of the coffin. Thus in folded position the thickness of the coffin is approximately equal to the thickness of the two frames 5 and 6. The supple coating covering the walls is also folded towards the inside. In this way the coffin folded in its storage and transportation position has a height six to ten times less than its height in service position.

When the coffin is unfolded to its service position, the flaps forming the short walls 4, and the end face 2*a* ensure by their setting in vertical position a wedging against the bottom 7 and a locking of the coffin in service position.

The coffin comprises further a fitting or inside upholstering made in a waterproof material. This fitting has the shape of a bag having the dimension of the inside of the box. It is fastened to said box by means of "Velcro" straps fixed respectively on the inside periphery of the upper frame 6 and on the periphery of the bag. This fitting is therefore removable.

The described coffin has the major advantage to be able to be folded in storage and transportation position permitting the industrial manufacture of coffins by mass production to be thereafter shipped to their place of use. The net cost of these coffins can thus be reduced.

Figure 3:
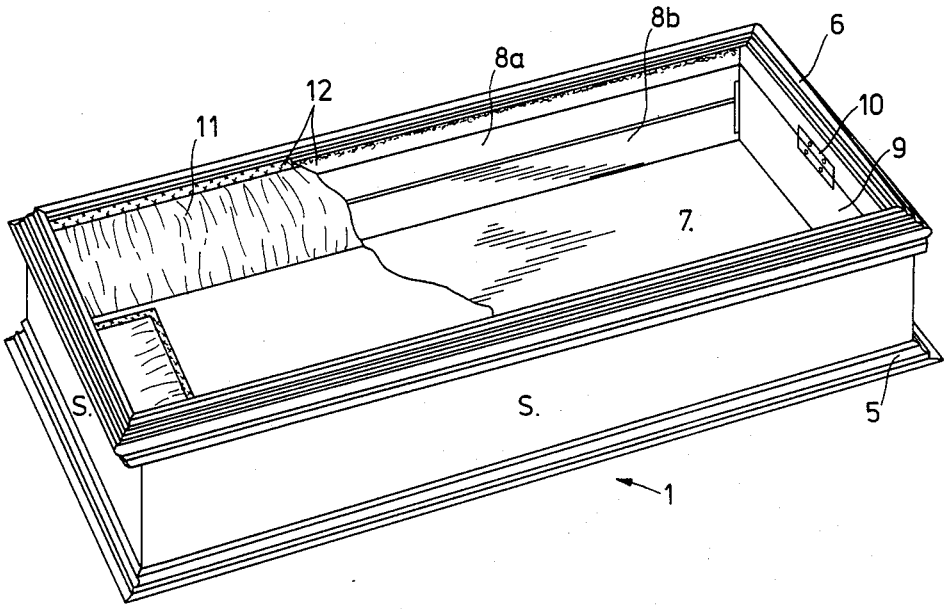
FIGS. 3 and 4 are views similar to FIGS. 1 and 2 of a second embodiment of the coffin.
Figure 4:
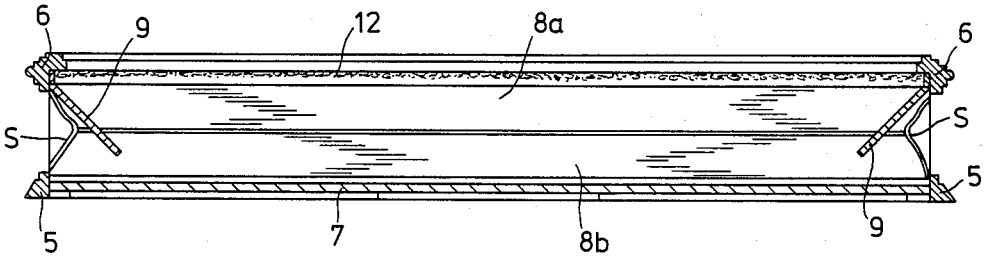

In the second embodiment shown in FIGS. 3 and 4 the foldable coffin is rectangular. It comprises here again an upper frame 6, a lower frame 5 and a bottom 7. The long sides are each formed of two flaps 8*a*, 8*b* hinged together and respectively with the frames 5 and 6 and are covered by an envelope S covering the whole periphery of the coffin.

The short sides are each only one flap 9 hinged at 10 on one of the frames 5 or 6. In service position these flaps 9, wedged against the bottom, lock the coffin.

To fold the coffin, these flaps 9 are folded inwardly, enabling the flaps 8*a* and 8*b* of the long sides to be folded also inwardly.

The fitting 11 of the coffin can be realized as a bag or tight envelope taking the shape of the inside of the coffin in service position and fixed to the periphery of its opening by a "Velcro" strip 12 for example.

In order to work the foldable coffin must have alternately sides formed of only one flap and sides formed of two flaps. On the sides formed of two flaps, the coating S can be glued or fixed on these flaps and constitute the hinges connecting them. However, on the sides formed of only one flap the coating is only stretched on it, and not fastened.

Figure 5:
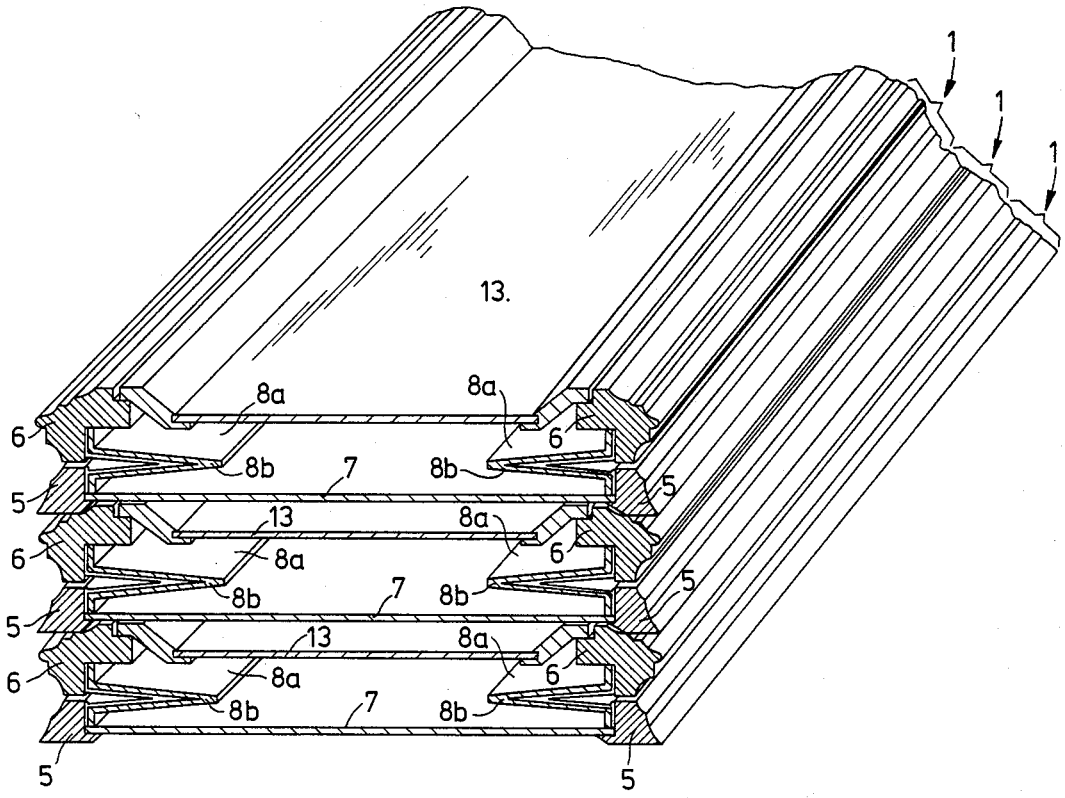
FIG. 5 shows a stack of coffins folded for storage and transportation.

FIG. 5 shows a stack of coffins folded for transportation. One can see that covers 13, laid upside-down, are located inside the central void of the corresponding folded coffin.

Thanks to this foldable design of the coffin its transportation is no more an obstacle to its manufacture in advance and its centralized storage, which enables considerably lowering its price.

What I claim is:

1. Coffin comprising a box having a cover, an upper frame, a lower frame, and an inside fitting, the box having hinged lateral walls permitting its folding to a storage and transportation position in which its height is a fraction of its height in service position, half of the lateral walls being formed of only one flap hinged on one of said frames whereas the other half of the lateral walls are made of two flaps hinged together along a middle line and to each of the frames respectively along directions parallel to said middle line, the walls formed by only one flap comprising locking means for the coffin in service position, the outside periphery of the coffin being covered with a supple and tight envelope covering said lateral walls.

2. Coffin as claimed in claim 1, in which the inside fitting is a bag having the shape of the inside of the box in service position and is fixed along the opening of the box.

3. Coffin as claimed in claim 1, in which a lateral wall formed of only one flap is located between two lateral walls each formed of two flaps.

4. Coffin as claimed in claim 1, in which said upper frame has a peripheral recess adapted to receive a lower peripheral edge portion of said cover, said cover being invertible on said upper frame to rest in an inverted position also in said peripheral recess thereby to provide in said inverted position a compact comfiguration of the cover for storage when the coffin is in said folded storage and transportation position.

5. A coffin as claimed in claim 1, in which said supple and tight envelope covers only said lateral walls and leaves said upper and lower frame exposed.

* * * * *